US006084362A

United States Patent [19]

Chao

[11] Patent Number: 6,084,362

[45] Date of Patent: Jul. 4, 2000

[54] ELECTRONIC BALLAST CAPABLE OF LINEAR AND STEPLESS LIGHT REGULATION

[76] Inventor: Wen-Shin Chao, No. 97, Sec. 3, Chang Mei Road, Ho Mei Chen, Chang Hua Hsien, Taiwan

[21] Appl. No.: 09/232,656

[22] Filed: Jan. 19, 1999

[51] Int. Cl.[7] ..... G05F 1/00

[52] U.S. Cl. ..... 315/291; 315/209 R; 315/224; 315/307

[58] Field of Search ..... 315/291, 205, 315/207, 209 R, 224, 244, 248, 260, 283, 284, 307, DIG. 5, DIG. 7

[56] References Cited

U.S. PATENT DOCUMENTS

| | | | |
|---|---|---|---|
| 4,553,070 | 11/1985 | Sairanen et al. | 315/209 R |
| 5,408,162 | 4/1995 | Williams | 315/224 |
| 5,739,645 | 4/1998 | Xia et al. | 315/307 |
| 5,828,187 | 10/1998 | Fischer | 315/291 |

*Primary Examiner*—Haissa Philogene
*Assistant Examiner*—Thuy Vinh Tran
*Attorney, Agent, or Firm*—Dougherty & Troxell

[57] ABSTRACT

An electronic ballast capable of linear and stepless light regulation that utilizes a chopped positive pulse passing through a limiting inductor and through two cathode coils of a fluorescent tube to a first mutual inductor and passing through a second transistor to excite the fluorescent lamp to radiate light. The luminosity is dependent upon the size of the portion of the positive pulse of the sinusoidal wave that is chopped. The chopped positive pulse utilizes the counter electromotive force generated by a first mutual inductor with respect to second and third mutual inductors to form semi-symmetrical resonance to maintain the pulse signals that pass through the fluorescent lamp to thereby continuously excite the cathode coils of the fluorescent lamp so that the latter always has the required luminosity. In this way, chopped power source waveforms are used to achieve linear light regulation so as to achieve zero dissipation, non-flashing during light regulation, and an increased light regulation range.

1 Claim, 2 Drawing Sheets

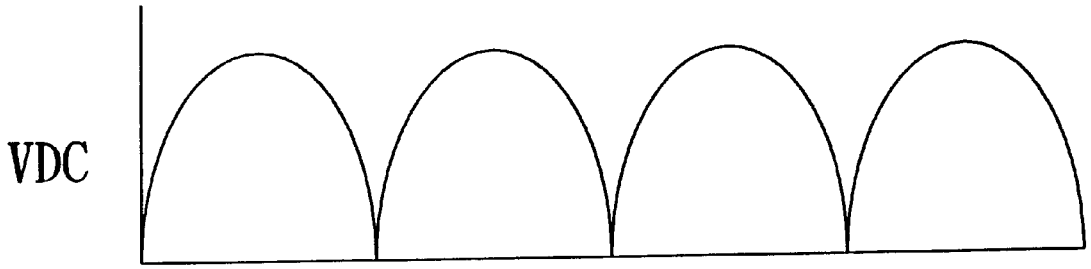
FIG2
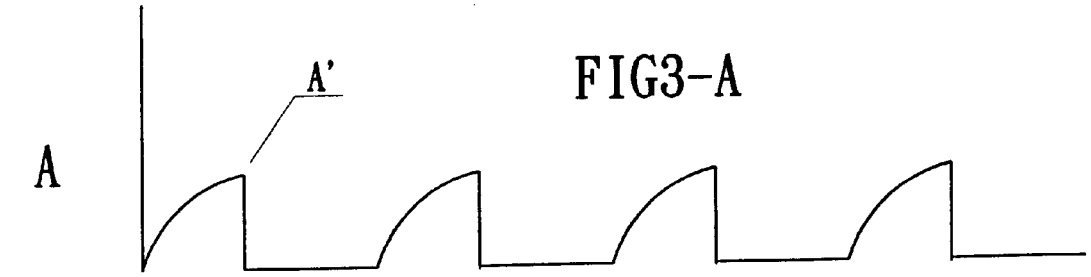
FIG3-A
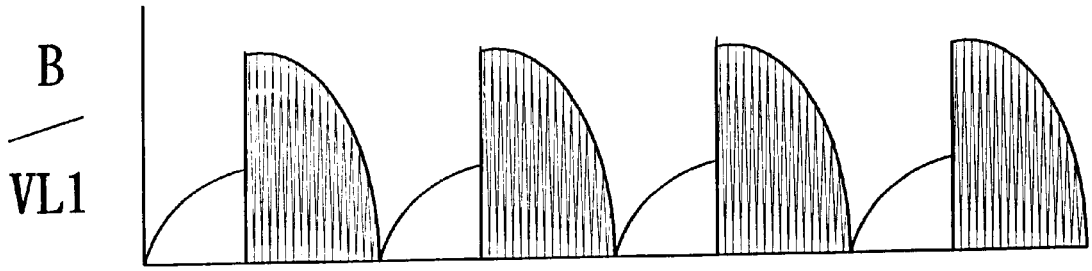
FIG4
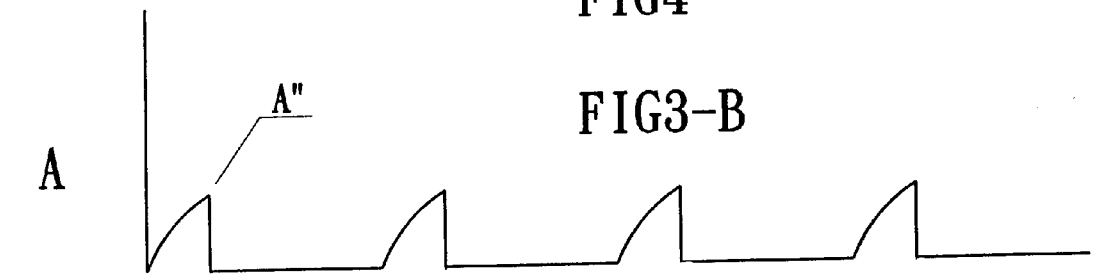
FIG3-B
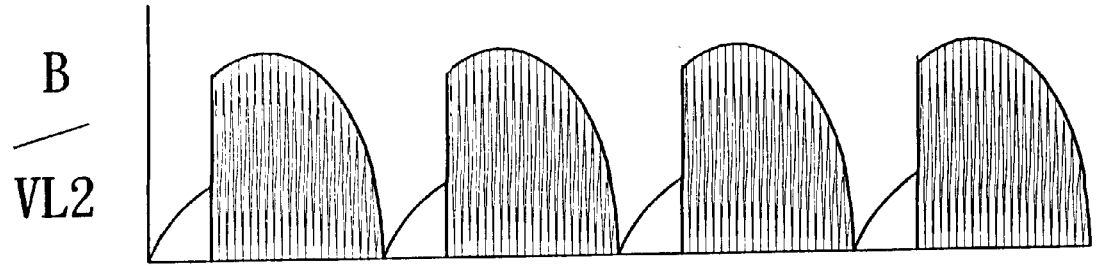
FIG5

ELECTRONIC BALLAST CAPABLE OF LINEAR AND STEPLESS LIGHT REGULATION

BACKGROUND OF THE INVENTION (a) Field of the Invention

The present invention relates to an electronic ballast capable of linear and stepless light regulation, more particularly to an electronic ballast in which the modulation of a variable resistor is utilized to charge a fifth capacitor, the charging speed being contrary to the size of the modulated resistance value of the variable resistor. When the voltage of the fifth capacitor has reached a bending voltage of connection of a bilateral thyristor, the bending point slows down with the augmentation of the resistance. On the contrary, the smaller the resistance, the earlier the bending point, causing the bilateral thyristor become connected and output a trigger pulse, then the second transistor is connected, so that a positive pulse of a sinusoidal wave that passes a limiting inductor, two cathode coils of the fluorescent lamp, the first mutual inductor and the second transistor to be chopped. The size of the chopped pulse is determined according to the size of the resistance value to control the luminosity of the fluorescent lamp. The positive pulse of the chopped pulse is used to generate a counter electromotive force with respect to second and third mutual inductors when it passes through the first mutual inductor to chop the second transistor and connect the first transistor. The positive pulse passes through the first transistor and passes the first mutual inductor in a reverse direction, inducing a counter electromotive force in a reverse direction with respect to the second and third mutual inductors so that the first transistor is chopped and the second transistor is connected at the same time. The first transistor and the second transistor are alternately connected and cut off to form semi-symmetrical resonance to allow linear light regulation of the fluorescent lamp to maintain the required luminosity under modulation, thereby achieving no flashing during light regulation and an increased light regulation range under no dissipation.

(b) Description of the Prior Art

A conventional electronic ballast generally utilizes the size of the voltage to control the luminosity of the fluorescent lamp. However, there are at least the following drawbacks with the conventional ballast:

a) having an alternating resonance of 120 Hz.;

b) incapable of linear light regulation;

c) poor efficiency d) smaller light regulation range, about below 50%; and e) flashing during light regulation.

SUMMARY OF THE INVENTION

A primary object of the present invention is to provide an electronic ballast capable of linear and stepless light regulation in which circuits after commutation are used in light regulation, including use of three mutual inductors. The first mutual inductor has one end connected in cascade with a cathode coil of a fluorescent lamp, the other end connected to the third mutual inductor, an emitter of a first transistor, and a collector of a second transistor. A base of the second transistor is connected to the second mutual inductor and a bilateral thyristor. The latter is connected between a variable resistor and a fifth capacitor. When the resistance value of variable resistor is modulated to a required level, the greater the resistance value of the voltage waveform detected at a front end of the variable resistor, the slower the reaching of the bending voltage of connection of the bilateral thyristor. On the contrary, the smaller the resistance, the earlier the reaching of the being voltage of connection of the bilateral thyristor. When the bilateral thyristor is connected, a trigger pulse is output to connect the second transistor so that a positive pulse of a sinusoidal wave that passes through the second transistor is chopped. The greater the resistance value, the larger the chopped portion. The smaller the resistance value, the smaller the chopped portion. The chopped positive pulse of the sinusoidal wave passes through a limiting inductor past two cathode coils of the fluorescent lamp to the first mutual inductor and through the second transistor to excite the fluorescent lamp to radiate light. The larger the chopped portion, the lower the luminosity. Conversely, the smaller the chopped portion, the higher the luminosity. The chopped positive pulse of the sinusoidal wave utilizes the counter electromotive force generated by the first mutual inductor with respect to the second and third mutual inductors to alternately connect or cut off the first and second transistors to form a semi-symmetrical resonance to maintain the pulse signals that pass through the fluorescent lamp to continuously excite the cathode coils of the fluorescent lamp, so that the latter always maintains the required luminosity. In this way, the chopped positive pulse of the sinusoidal wave is utilized achieve linear light regulation, zero dissipation, non-flashing during light regulation, and an increased light regulation range.

Another object of the present invention is to provide an electronic ballast capable of linear and stepless light regulation, in which, between an emitter of a first transistor and a collector a second transistor, there is connected a resistor and a diode in cascade, to connect to between a variable resistor and a charging capacitor. The cascade connection of the resistor and the diode is utilized to prevent continuous triggering after a bilateral thyristor is triggered to thereby attain a protection effect.

BRIEF DESCRIPTION OF THE DRAWINGS

The foregoing and other features and advantages of the present invention will be more clearly understood from the following detailed description and the accompanying drawings, in which.

FIG. 2 is a schematic view of a positive pulse of a sinusoidal wave used by a power source according to the present invention;

FIG. 3A is a schematic view illustrating the pulse position of the bending voltage of a bilateral thyristor connected by a fifth capacitor in which a variable resistor is modulated to be greater;

FIG. 3B is a schematic view illustrating the pulse position of the bending voltage of a bilateral thyristor connected by a fifth capacitor in which a variable resistor is modulated to be smaller;

FIG. 4 is a schematic view of the waveforms of output pulses when first and second transistors are connected, in which the resistance value of the variable resistor is greater; and FIG. 5 is a schematic view of the waveforms of output pulses when first and second transistors are connected, in which the resistance value of the variable resistor is smaller.

DETAILED DESCRIPTION OF THE PREFERRED EMBODIMENT

Figure 1:
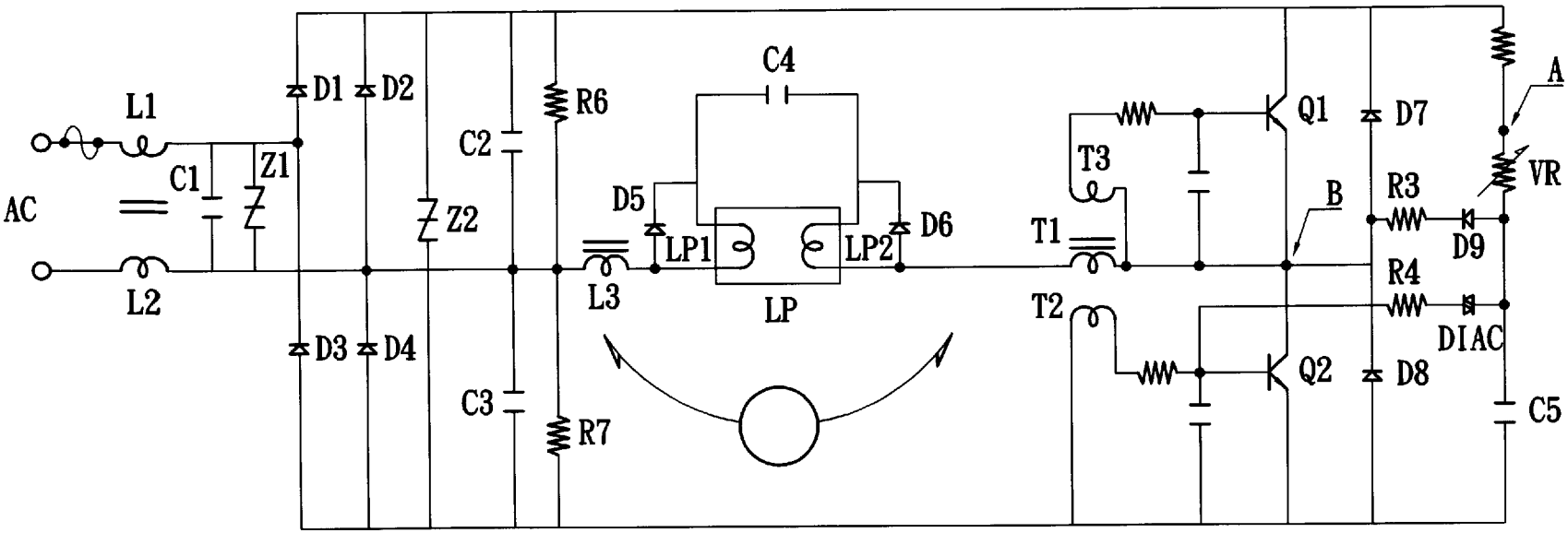
FIG. 1 is a circuit device diagram according to the present invention.

With reference to FIG. 1, the present invention includes a noise filter circuit comprised of a first inductor L1, a second inductor L2, and a first capacitor 1, which is connected in series to a first surge absorber Z1 to prevent generation of instant surge of the alternating currents and hence avoid damage to circuit parts. The first surge absorber Z1 has two ends respectively connected to a bridge commutator comprised of first, second, third, and fourth diodes D1, D2, D3, and D4 to provide commutation functions, but without surge prevention functions. A second surge absorber Z2 is connected to a second capacitor C2 and a third capacitor C3 in series, and is also connected to a sixth resistor R6 and a seventh resistor R7 in series. A mid-point voltage between the second and third capacitors C2 and C3, and that between the sixth and seventh resistors R6 and R7 are connected to a first cathode coil LP1 of one end of a fluorescent lamp LP to achieve a pulse signal of a high frequency but having low capacity. The first cathode coil LP1 is connected to a limiting inductor L3. The limiting inductor L3 utilizes different induction values depending on the power of the florescent lamp LP. Once the induction value of the limiting inductor L3 is set, the power of the fluorescent lamp LP can be determined. Furthermore, the first cathode coil LP1 and a second cathode coil LP2 on both sides of the fluorescent lamp LP are respectively connected to fifth and sixth diodes D5, D6 in series so as to detect the voltage wave forms of the first and second cathode coils LP1, LP2 and hence reduce their voltages. A fourth capacitor C4 is further connected between the first and second cathode coils LP1 and LP2 in series to be connected with the third inductor L3 in cascade so that the third inductor L3 and the fourth capacitor C4 form a serial resonator. One end of the second cathode coil LP2 is further connected to a first mutual inductor T1 in series. The first mutual inductor T1 is connected respectively to a third mutual inductor T3, an emitter of a first transistor Q1, a collector of a second transistor Q2, between seventh and eight diodes D7, D8 that are comnected in cascade, and further to a third resistor R3 and a ninth diode D9 to be connected between a variable resistor VR and a fifth capacitor C5. The fifth capacitor C5 is connected to a bilateral thyristor DIAC and a fourth resistor R4 to be respectively connected to a base of the second transistor Q2 and a second mutual inductor T2.

FIG. 2 shows a positive pulse power source waveform VDC of a sinusoidal wave output by an alternating current AC through the first, second, third, and fourth diodes D1, D2, D3, D4. When the power source waveform VDC charge the fifth capacitor C5 via the variable resistor V5, a voltage waveform (as shown in FIGS. 3A and 3B) is detected at a point A at a front end of the variable resistor VR. The greater the value of resistance of the variable resistor VR, the slower the reaching of the bending voltage of the connection of the bilateral thyristor DIAC by the fifth capacitor C5, as the bending point A' shown in FIG. 3A. On the contrary, the smaller the resistance value, the quicker the reaching of the bending voltage of the connection of the bilateral thyristor DIAC by the fifth capacitor C5, as the point A" in FIG. 3B. When the resistance value of the variable resistor VR is modulated to be greater, the bending point A' detected corresponds to the connection of the second transistor Q2 so that a larger portion of the positive pulse waveform VL1 of the sinusoidal wave that passes through the second transistor Q2 is chopped (as shown in FIG. 4). On the contrary, when the resistance value of the variable resistor VR is modulated to be smaller, the bending point A" detected corresponds to the connection of the second transistor Q2 so that a smaller portion of the positive pulse waveform VL2 of the sinusoidal wave of the second transistor Q2 is chopped (as shown in FIG. 5). The positive pulse VL1 or VL2 of the chopped sinusoidal wave passes through the limiting inductor L3 through the two cathode coils LP1, LP2 of the fluorescent lamp LP to the first mutual inductor T1 and through the second transistor Q2 to excite the fluorescent lamp LP to radiate light. The luminosity will vary depending on the point where the positive pulse VL1, VL2 of the sinusoidal wave is chopped. In other words, the positive pulse VL1 (as shown in FIG. 4) of the sinusoidal wave that passes through the fluorescent lamp LP has a lower luminosity, whereas the positive pulse VL2 (as shown in FIG. 5) of the sinusoidal wave that passes through the fluorescent lamp LP has a higher luminosity. Therefore, the luminosity of the fluorescent lamp LP can be adjusted via the variable resistor VR, and the regulation range is between 20% to 120%. Furthermore, the chopped power source pulse VL1, VL2 pass through the first mutual inductor T1 to generate a counter electromotive force with respect to the second and third mutual inductors T2 and T3. The second mutual inductor T2 is induced to generate a counter electromotive force to chop the second transistor Q2, and the third mutual inductor T3 generates a counter electromotive force to conduct the first transistor Q1. Then the chopped positive pulse VL1 or VL2 of the sinusoidal wave passes through the first transistor Q1 and passes through the first mutual inductor T1 in a reverse direction, and further passes through the two cathode coils LP1, LP2 of the fluorescent lamp LP and the limiting inductor L3 so as to enable the fluorescent lamp LP to maintain the luminosity thereof. The positive pulse VL1 or VL2 that passes through the first mutual inductor T1 in a reverse direction and that generates a counter electromotive force with respect to the second and third mutual inductor T2, T3, to repeat the above-mentioned contrary actions. In this way, alternate connection or chopping of the first transistor Ql and the second transistor Q2 is carried out to form a semi-symmetrical resonance to maintain the chopped positive pulse signals VL1 or VL2 of the fluorescent lamp LP so as to continuously excite the cathode coils LP1, LP2 of the fluorescent lamp LP, thereby maintaining the required luminosity of the fluorescent lamp LP after regulation. It can therefore be appreciated that the present invention utilizes the positive pulse of the chopped sinusoidal wave to achieve linear light regulation so that dissipation is obviated, flashing during regulation is eliminated, and light regulation range is increased.

Although the present invention has been illustrated and described with reference to the preferred embodiment thereof, it should be understood that it is in no way limited to the details of such embodiment but is capable of numerous modifications within the scope of the appended claims.

What is claimed is:

1. An electronic ballast capable of linear and stepless light regulation, comprising:

a power protection circuit that includes a noise filter circuit comprising a first inductor, a second inductor, and a first capacitor connected in series to a first surge absorber to prevent generation of instant surge so as to prevent damage to circuit parts;

a commutation circuit that includes a bridge commutator comprising first, second, third, and fourth diodes connected respectively to two ends of said first surge absorber to provide a commutation function but without a filtering function, said commutator being connected in series to a second surge absorber to prevent instant surge;

a fluorescent lamp resonance circuit, said second surge absorber being connected in series to second and third capacitors respectively, and to sixth and seventh resistors, a mid-point voltage between said second and third capacitors, and that between said sixth and seventh resistors being connected to a first cathode coil at one end of a fluorescent lamp to obtain a high frequency low capacity pulse signal, and said first cathode coil being connected in cascade to a limiting inductor in front thereof, said limiting inductor utilizing different induction values depending on the power of the fluorescent lamp such that once the induction value of said limiting inductor is set, the power of the fluorescent lamp is determinable;

a transistor semi-symmetrical consonance circuit including fifth and sixth diodes connected in series to said first cathode coil and a second cathode coil at both ends of the fluorescent lamp to respectively detect the voltage waveforms of said first and second cathode coils and reduce the voltages thereof, a fourth capacitor being connected in series between said first and second cathode coils and connected in cascade with a third inductor so that said third inductor and said fourth capacitor form a serial resonator; wherein said electronic ballast further comprises:

a first mutual inductor in which one end of said second cathode coil is connected in cascade to said first cathode coil, said first mutual inductor being connected to a third mutual inductor, an emitter of a first transistor, a collector of a second transistor, between seventh and eighth diodes that are connected in cascade, a second mutual inductor being connected independently to a base of said second transistor;

a trigger and light regulating loop in which a variable resistor is connected to a fifth capacitor in cascade, and a bilateral thyristor and a fourth resistor being connected to where said variable resistor and said fifth capacitor are connected so as to be connected respectively to said base of said second transistor and said second mutual inductor;

a protection loop connected to a collector of said second transistor to be connected in cascade to a ninth diode with a third resistor and between said variable resistor and a charging capacitor, said ninth diode being utilized to isolate power source pulses to prevent continuous triggering after said bilateral thyristor has been triggered;

whereby power source chopped pulses are utilized to achieve linear light regulation of the fluorescent lamp to achieve zero dissipation, non-flashing during light regulation, and an increased light regulation range.

* * * * *